US010845732B2

(12) United States Patent
Kitamura et al.

(10) Patent No.: US 10,845,732 B2
(45) Date of Patent: Nov. 24, 2020

(54) DEVELOPER CONTAINER AND IMAGE FORMING APPARATUS INCORPORATING SAME

(71) Applicants: Gen Kitamura, Shizuoka (JP); Seiji Terazawa, Shizuoka (JP); Yasushi Tanaka, Tonami (JP)

(72) Inventors: Gen Kitamura, Shizuoka (JP); Yuuta Tanaka, Tonami (JP); Seiji Terazawa, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/613,346

(22) PCT Filed: May 2, 2018

(86) PCT No.: PCT/JP2018/017514
§ 371 (c)(1),
(2) Date: Nov. 13, 2019

(87) PCT Pub. No.: WO2018/211995
PCT Pub. Date: Nov. 22, 2018

(65) Prior Publication Data

US 2020/0192243 A1 Jun. 18, 2020

(30) Foreign Application Priority Data

May 18, 2017 (JP) ..... 2017-099157

(51) Int. Cl.
*G03G 15/08* (2006.01)

(52) U.S. Cl.
CPC ..... *G03G 15/0886* (2013.01)

(58) Field of Classification Search
CPC ..... G03G 15/0886
See application file for complete search history.

(56) References Cited

U.S. PATENT DOCUMENTS 5,576,816 A * 11/1996 Staudt ..... G03G 15/0884 222/DIG. 1
6,169,864 B1 * 1/2001 Baxendell ..... G03G 15/0886 399/106

(Continued)

FOREIGN PATENT DOCUMENTS

EP 2806312 A1 11/2014
JP 2015-004963 1/2015
JP 2016-018003 2/2016

OTHER PUBLICATIONS

International Search Report and Written Opinion dated Aug. 7, 2018 in PCT/JP2018/017514 filed on May 2, 2018.

*Primary Examiner* — David J Bolduc
(74) *Attorney, Agent, or Firm* — Oblon, McClelland, Maier & Neustadt, L.L.P.

(57) ABSTRACT

A toner container includes a shutter to open and close an opening into which the nozzle is inserted, a guide rod provided together with the shutter, and a compression spring that urges the shutter in the closing direction. Further, the toner container includes a holder including a holding portion including at least two portions to support the guide rod movably in an opening and closing direction, a fitting portion having the opening, to fit into a container body, and a bridge portion to connect the holding portion and the fitting portion. A circumferential area around the guide rod and the compression spring that faces the bridge portion is smaller than a circumferential area around the guide rod and the compression spring that does not face the bridge portion. the shutter and the guide rod (or the nozzle) moves smoothly in the opening and closing direction.

12 Claims, 18 Drawing Sheets

(56) References Cited

U.S. PATENT DOCUMENTS

2002/0114646 A1* 8/2002 Sudo ..... G03G 15/0855 399/258
2007/0122205 A1* 5/2007 Taguchi ..... G03G 15/0855 399/258
2007/0147902 A1* 6/2007 Taguchi ..... G03G 15/0886 399/262
2009/0263146 A1* 10/2009 Pearce ..... G03G 15/0856 399/27
2010/0003055 A1* 1/2010 Kikuchi ..... G03G 15/0855 399/258
2011/0058857 A1* 3/2011 Hori ..... G03G 15/0867 399/262
2011/0123216 A1 5/2011 Mitsuishi et al.
2011/0222871 A1* 9/2011 Suzuki ..... G03G 15/0872 399/27
2011/0286771 A1 11/2011 Taguchi et al.
2012/0033998 A1* 2/2012 Hori ..... G03G 15/0872 399/258
2012/0163877 A1* 6/2012 Kikuchi ..... G03G 15/0872 399/262
2012/0195645 A1* 8/2012 Takami ..... G03G 15/0886 399/262
2012/0213555 A1* 8/2012 Komatsu ..... G03G 15/087 399/262
2012/0234735 A1 9/2012 Ichikawa et al.
2012/0321341 A1* 12/2012 Hori ..... G03G 15/0877 399/110
2013/0216269 A1 8/2013 Yamabe et al.
2013/0216270 A1 8/2013 Yamabe et al.
2013/0216271 A1 8/2013 Yamabe et al.
2013/0272750 A1* 10/2013 Matsumoto ..... G03G 15/0879 399/262
2013/0330106 A1 12/2013 Mitsuishi et al.
2014/0029973 A1 1/2014 Terazawa et al.
2014/0064795 A1 3/2014 Terazawa et al.
2014/0241757 A1* 8/2014 Kikuchi ..... G03G 15/0877 399/258
2014/0270859 A1* 9/2014 Hosokawa ..... G03G 15/0886 399/262
2014/0348546 A1 11/2014 Kojima et al.
2014/0348551 A1 11/2014 Yamabe et al.
2015/0293474 A1 10/2015 Mitsuishi et al.
2015/0338775 A1* 11/2015 Hosokawa ..... G03G 15/0868 399/258
2016/0033898 A1 2/2016 Yamabe et al.
2016/0070204 A1* 3/2016 Suzuki ..... G03G 15/0886 399/258
2016/0124346 A1 5/2016 Yamabe et al.
2016/0161885 A1 6/2016 Hosokawa et al.
2016/0202632 A1 7/2016 Mitsuishi et al.
2016/0252846 A1 9/2016 Suiseki et al.
2017/0102638 A1 4/2017 Yamabe et al.
2017/0108799 A1 4/2017 Hosokawa et al.
2017/0139350 A1 5/2017 Yano et al.

* cited by examiner

DEVELOPER CONTAINER AND IMAGE FORMING APPARATUS INCORPORATING SAME

TECHNICAL FIELD

Embodiments of the present disclosure generally relate to a developer container to contain developer such as toner or the like and an image forming apparatus incorporating the same.

BACKGROUND ART

For image forming apparatuses, such as copiers, printers, facsimile machines, or multifunction peripherals (MFPs), there are toner containers (developer containers) removably installed in an apparatus bodies of the image forming apparatuses. The toner container is bottle-shaped, and a nozzle of the apparatus body is inserted into an opening of the toner container when the toner container is installed in the apparatus, to discharge toner (developer) contained in the toner container (for example, Patent Documents 1 and 2).

Specifically, in the toner container in Patent Documents 1 and 2, a shutter to open and close the opening, into which the nozzle is inserted, is formed together with a guide rod. The guide rod is movably supported in an opening and closing direction (axial direction) in the toner container by a shutter holder.

When the toner container is not installed in the apparatus, the shutter is urged by a compression spring wound around the guide rod and moves to a position to close the opening.

On the other hand, when the toner container is installed in the apparatus, the shutter is pushed by the nozzle and moves together with the guide rod to a position to open the opening in conjunction with the installation of the toner container in the apparatus. Then, as a container body, which is rotatable relative to the shutter holder, of the toner container rotates, toner (developer) contained in the toner container is discharged to an outside of the toner container via the nozzle inserted into the opening.

CITATION LIST

Patent Literature

PTL 1: JP-2016-018003-A
PTL 2: JP-2015-004963-A

SUMMARY OF INVENTION

Technical Problem

In the toner container (the developer container) described above, a holder (a shutter support) to support the guide rod covers over half of the circumference of the guide rod and the compression spring (or the nozzle). As a result, the toner (developer) is agglomerated between the holder, and the guide rod and compression spring (or the nozzle). Therefore, a problem may occur that a shutter and a guide rod (or a nozzle) do not move smoothly in an opening and closing direction, causing the shutter to fail to open and close, or toner (developer) contained in the toner container is not discharge satisfactorily via the nozzle.

The present disclosure has an object to provide a toner container (a developer container) and an image forming apparatus to prevent a problem that a shutter and a guide rod (or a nozzle) do not move smoothly in an opening and closing direction, or toner (developer) contained in the toner container is not discharge satisfactorily via the nozzle.

Solution to Problem

A developer container removably installed in an apparatus body of an image forming apparatus includes a container body to contain developer; a shutter to open and close an opening of the developer container in conjunction with installation of the developer container in the apparatus body; a guide rod formed together with the shutter in one piece; a holder including a fitting portion, a holding portion, and a bridge portion; and a compression spring to urge the shutter in a direction to close the opening. The nozzle of the apparatus body is inserted into the opening. The guide rod extends in an opening and closing direction of the shutter inside the developer container. The holding portion is disposed opposite the shutter in the developer container and includes at least two portions to support the guide rod movably in an opening and closing direction. The fitting portion having the opening fits into the container body. The bridge portion connects the holding portion and the fitting portion inside the developer container. The compression spring is wound around the guide rod and faces the bridge portion between the shutter and the holding portion. The shutter is pushed by the nozzle against an urging force of the compression spring in conjunction with the installation of the developer container in the apparatus body and moves inside the developer container together with the guide rod, to open the opening, The shutter is released by the nozzle in conjunction with the removal of the developer container from the apparatus body and moves toward the opening together with the guide rod by the urging force of the compression spring, to close the opening. A circumferential area around the guide rod and the compression spring that faces the bridge portion is smaller than a circumferential area around the guide rod and the compression spring that does not face the bridge portion.

Advantageous Effects of Invention

The present disclosure can provide a developer container and an image forming apparatus in which the shutter and the guide rod (or the nozzle) moves smoothly in the opening and closing direction, or developer contained in the developer container is discharged satisfactorily via the nozzle.

DESCRIPTION OF EMBODIMENTS

Figure 1:
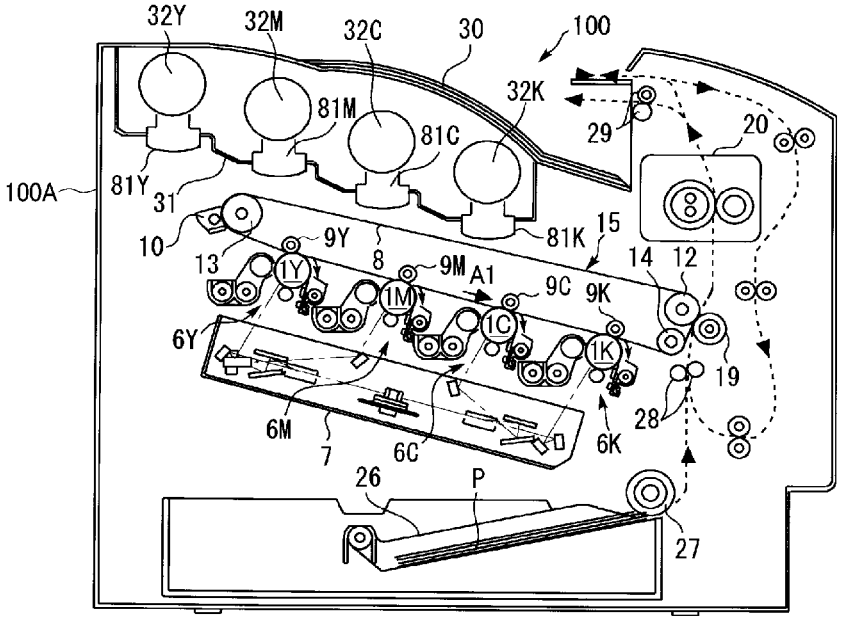
FIG. 1 is a schematic view of an image forming apparatus according to an embodiment of the present disclosure.

In describing embodiments illustrated in the drawings, specific terminology is employed for the sake of clarity. However, the disclosure of this patent specification is not intended to be limited to the specific terminology so selected, and it is to be understood that each specific element includes all technical equivalents that have the same function, operate in a similar manner, and achieve a similar result.

As used herein, the singular forms "a", "an", and "the" are intended to include the plural forms as well, unless the context clearly indicates otherwise.

It is to be noted that the suffixes Y, M, C, and K attached to each reference numeral indicate only that components indicated thereby are used for forming yellow, magenta, cyan, and black images, respectively, and hereinafter may be omitted when color discrimination is not necessary.

Referring to the drawings, embodiments of the present disclosure are described below. It is to be understood that an identical or similar reference character is given to identical or corresponding parts throughout the drawings, and redundant descriptions are omitted or simplified below.

Figure 2:
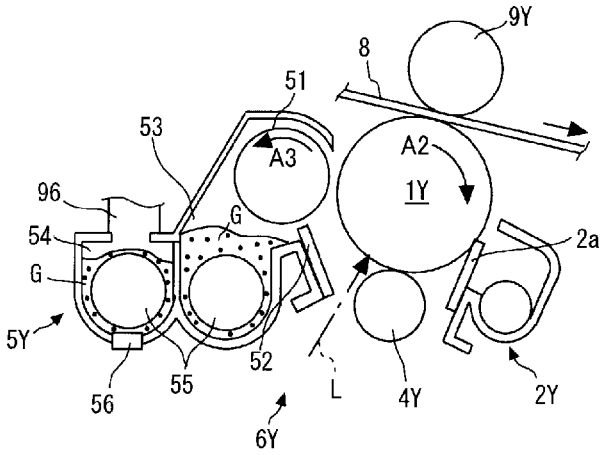
FIG. 2 is a schematic cross-sectional view of an image forming unit of the image forming apparatus in FIG. 1.
Figure 3:
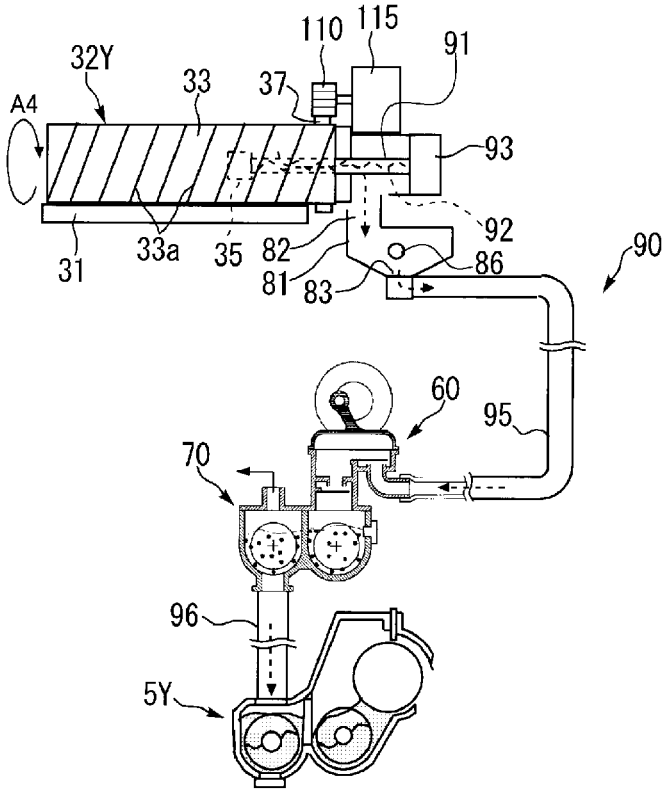
FIG. 3 is a schematic view of the toner supply device of the image forming apparatus illustrated in FIG. 1.

Referring to FIGS. 1 to 3, descriptions are provided of a configuration and operation of an image forming apparatus 100 according to the present embodiment.

FIG. 1 is a schematic view of the image forming apparatus 100, which in the present embodiment is a printer. FIG. 2 is a schematic enlarged view of an image forming unit 6 of the image forming apparatus 100. FIG. 3 is a schematic view of a toner supply device 90 (a developer supply device) of the image forming apparatus 100.

As illustrated in FIG. 1, in an upper part of an apparatus body of the image forming apparatus 100, four toner containers 32Y, 32M, 32C, and 32K (developer containers) respectively corresponding to yellow, magenta, cyan, and black are removably installed in toner container mounts 31. The toner container 32 is substantially cylindrical. Hoppers 81Y, 81M, 81C, and 81K of toner supply devices 90 are disposed below the toner containers 32Y, 32M, 32C, and 32K, respectively.

An intermediate transfer unit 15 is disposed below the toner container mounts 31 (the toner containers 32). Four image forming units 6Y, 6M, 6C, and 6K are arranged side by side, facing an intermediate transfer belt 8 of the intermediate transfer unit 15 to form toner images of yellow, magenta, cyan, and black, respectively.

Referring to FIG. 2, the image forming unit 6Y for yellow includes a photoconductor drum 1Y serving as an image bearer and further includes a charger 4Y, a developing device 5Y, a cleaner 2Y, a discharger, and the like disposed around the photoconductor drum 1Y. Image forming processes, namely, charging, exposure, development, transfer, and cleaning processes are performed on the photoconductor drum 1Y, and thus a yellow toner image is formed on the photoconductor drum 1Y.

The other image forming units 6M, 6C, and 6K have a similar configuration to that of the yellow image forming unit 6Y except the color of the toner used therein and form magenta, cyan, and black toner images, respectively. Thus, only the image forming unit 6Y is described below and descriptions of the other image forming units 6M, 6C, and 6K are omitted.

Referring to FIG. 2, the photoconductor drum 1Y is rotated clockwise indicated by arrow A2 in FIG. 2 by a motor. The charger 4Y uniformly charges a surface of the photoconductor drum 1Y at a position opposite the charger 4Y (a charging process).

When the photoconductor drum 1Y reaches a position to receive a laser beam L emitted from an exposure device 7 (i.e., a writing device), the photoconductor drum 1Y is scanned with the laser beam L, and thus an electrostatic latent image for yellow is formed thereon (an exposure process).

Then, the photoconductor drum 1Y reaches a position facing the developing device 5Y, where the electrostatic latent image is developed with toner into a yellow toner image (a development process).

When the surface of the photoconductor drum 1Y carrying the toner image reaches a position facing the primary-transfer bias roller 9Y via the intermediate transfer belt 8, the toner image is transferred therefrom onto the intermediate transfer belt 8 (a primary-transfer process). After the primary transfer process, a certain amount of toner remains untransferred on the photoconductor drum 1Y.

When the surface of the photoconductor drum 1Y reaches a position facing the cleaner 2Y, a cleaning blade 2*a* of the cleaner 2Y collects the untransferred toner on the photoconductor drum 1Y (a cleaning process).

Subsequently, the surface of the photoconductor drum 1Y reaches a position facing the discharger, and the discharger removes residual potential of the photoconductor drum 1Y.

Thus, a sequence of image forming processes performed on the photoconductor drum 1Y is completed.

The above-described image forming processes are performed in the image forming units 6M, 6C, and 6K similar to the yellow image forming unit 6Y. That is, the exposure device 7 disposed below the image forming units 6M, 6C, and 6K irradiates the photoconductor drums 1M, 1C, and 1K of the image forming units 6M, 6C, and 6K with the laser beam L based on image data. Specifically, the exposure device 7 includes a light source to emit the laser beams L, multiple optical elements, and a polygon mirror that is rotated by a motor. The exposure device 7 directs the laser beams L to the photoconductor drums 1M, 1C, and 1K via the multiple optical elements while deflecting the laser beams L with the polygon mirror.

Then, the toner images formed on the photoconductor drums 1 through the development process are transferred therefrom and deposited one on another on the intermediate transfer belt 8. Thus, a multicolor toner image is formed on the intermediate transfer belt 8.

The intermediate transfer unit 15 includes the intermediate transfer belt 8, the four primary-transfer bias rollers 9Y, 9M, 9C, and 9K, a secondary-transfer backup roller 12, a cleaning backup roller 13, a tension roller 14, and a belt cleaner 10. The intermediate transfer belt 8 is supported by the secondary-transfer backup roller 12, the cleaning backup roller 13, and the tension roller 14. The secondary-transfer backup roller 12 serves as a driving roller to rotate the intermediate transfer belt 8 counterclockwise indicated by arrow A1 in FIG. 1.

The four primary-transfer bias rollers 9Y, 9M, 9C, and 9K are pressed against the corresponding photoconductor drums 1Y, 1M, 1C, and 1K via the intermediate transfer belt 8, thereby forming primary transfer nips between the intermediate transfer belt 8 and the photoconductor drums 1Y, 1M, 1C, and 1K. A primary-transfer bias having a polarity opposite a polarity of toner is applied to the primary-transfer bias rollers 9Y, 9M, 9C, and 9K.

While rotating in the direction indicated by the arrow A1 illustrated in FIG. 1, the intermediate transfer belt 8 sequentially passes through the primary transfer nips corresponding to the primary-transfer bias rollers 9Y, 9M, 9C, and 9K. Then, the single-color toner images are primarily transferred from the respective photoconductor drums 1Y, 1M, 1C, and 1K and deposited one on another on the intermediate transfer belt 8.

Then, the intermediate transfer belt 8 carrying the multicolor toner image reaches a position facing the secondary transfer roller 19. The secondary-transfer backup roller 12 and the secondary transfer roller 19 press against each other via the intermediate transfer belt 8, and the contact portion therebetween is hereinafter referred to as a secondary transfer nip. The multicolor toner image on the intermediate transfer belt 8 is transferred onto a sheet P (a recording medium) transported to the secondary transfer nip (a secondary transfer process). A certain amount of toner remains untransferred on the intermediate transfer belt 8 after the secondary transfer process.

Then, the intermediate transfer belt 8 reaches a position facing the belt cleaner 10, where the untransferred toner is collected from the intermediate transfer belt 8.

Thus, a sequence of image transfer processes performed on the intermediate transfer belt 8 is completed.

The sheet P is transported from a sheet feeding tray 26 disposed in a lower portion of the apparatus body 100A to the secondary transfer nip via a sheet feeding roller 27 and a registration roller pair 28.

More specifically, the sheet feeding tray 26 contains a stack of multiple sheets P piled one on another. As the sheet feeding roller 27 rotates counterclockwise in FIG. 1, the sheet feeding roller 27 feeds the sheet P on the top of the stack in the sheet feeding tray 26 to a roller nip formed between two rollers of the registration roller pair 28.

The registration roller pair 28 (a timing roller pair) stops rotating temporarily, stopping the sheet P with a leading edge of the sheet P nipped in the registration roller pair 28. The registration roller pair 28 resume rotation to transport the sheet P to the secondary transfer nip, timed to coincide with the arrival of the multicolor toner image on the intermediate transfer belt 8. Thus, the multicolor toner image is transferred onto the sheet P.

The sheet P carrying the multicolor toner image is transported to a fixing device 20. In the fixing device 20, a fixing roller and a pressure roller apply heat and pressure to the sheet P to fix the multicolor toner image on the sheet P.

Subsequently, the sheet P is discharged by a sheet ejection roller pair 29 outside the apparatus body 100A and stacked on an output tray 30 as an output image.

Thus, a sequence of image forming processes performed by the image forming apparatus 100 is completed.

Next, a detailed description is provided of a configuration and operation of the developing device 5Y referring to FIG. 2.

The developing device 5Y includes a developing roller 51 disposed facing the photoconductor drum 1Y, a doctor blade 52 opposed to the developing roller 51, two conveying screws 55 disposed within the developer housings 53 and 54, and a toner concentration detector 56 to detect concentration of toner in developer G. The developing roller 51 includes stationary magnets, a sleeve that rotates around the magnets, and the like. The developer housings 53 and 54 contain two-component developer G including carrier (carrier particles) and toner (toner particles).

With such a configuration, the developing device 5Y operates as follows.

The sleeve of the developing roller 51 rotates in a direction indicated by arrow A3 illustrated in FIG. 2. The developer G is carried on the developing roller 51 by a magnetic field generated by the magnets. As the sleeve rotates, the developer G moves along a circumference of the developing roller 51.

The percentage (concentration) of toner in the developer G (ratio of toner to carrier) in the developing device 5Y is adjusted to within a predetermined range. More specifically, the toner supply device 90 supplies toner from the toner container 32Y to the developer housing 54 as the toner in the developing device 5 is consumed.

The two conveying screws 55 stirs and mixes the developer G with the toner added to the developer housing 54 while circulating the developer G in the developer housings 53 and 54. In this case, the developer G moves in a direction perpendicular to the surface of the paper on which FIG. 2 is drawn. The toner in the developer G is charged by friction with the carrier and electrostatically attracted to the carrier. Then, the toner is carried on the developing roller 51 together with the carrier by a magnetic force generated on the developing roller 51.

The developer G carried on the developing roller 51 is transported in the clockwise direction indicated by arrow A3 in FIG. 2 to a position opposite the doctor blade 52. The amount of developer G on the developing roller 51 is adjusted by the doctor blade 52, after which the developer G is carried to a developing range facing the photoconductor drum 1Y. Then, the toner in the developer G is adsorbed to the electrostatic latent image formed on the photoconductor drum 1Y due to the effect of an electric field generated in the developing range. As the sleeve rotates, the developer G remaining on the developing roller 51 reaches an upper part of the developer housing 53 and drops from the developing roller 51.

Next, a configuration and operation of the toner supply device 90 (the developer supply device) illustrated in FIG. 3 is described.

In the toner supply device 90, the toner container 32Y as the developer container is installed in the toner container mount 31 and rotated in a predetermined direction (the direction indicated by arrow A4 in FIG. 3) so that the toner contained in the toner container 32Y is discharged to the outside of the toner container 32Y and guided to the developing device 5Y via a sub-hopper 70, to form a toner supply route (a toner transport route).

In FIG. 3, the arrangement direction of the toner container 32Y, the toner supply device 90, and the developing device 5Y are changed for ease of understanding. In the present embodiment, the longitudinal axis of the toner container 32Y and a part of the toner supply device 90 is perpendicular to the surface of the paper on which FIG. 3 is drawn as illustrated in FIG. 1. In addition, the orientation and arrangement of a conveyance tube 95 and a conveyance pipe 96 are also illustrated in a simplified manner.

The respective color toners contained in the toner containers 32Y, 32M, 32C, and 32K installed in the toner container mount 31 are supplied to the corresponding developing devices 5Y, 5M, 5C, and 5K by the toner supply devices 90 in an amount determined by the amount of toner consumed in the corresponding developing devices 5. The four toner supply devices 90 are identical except for the color of the toner used in the image forming process.

Figure 4A:
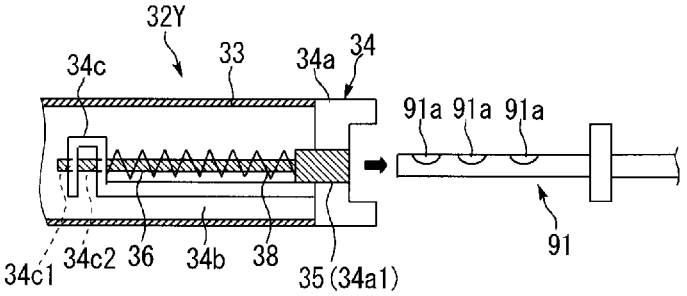
FIG. 4A is a schematic view illustrating a movement in which a nozzle of an apparatus body of the image forming apparatus in FIG. 1 is removed from a toner container to be installed in the apparatus.
Figure 4B:
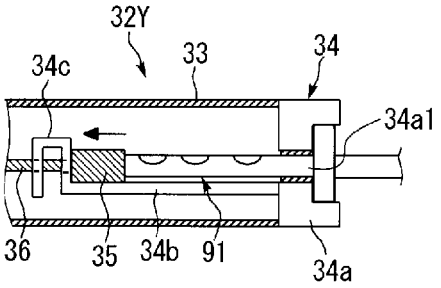
FIG. 4B is a schematic view illustrating a movement in which a nozzle of an apparatus body of the image forming apparatus in FIG. 1 is inserted into a toner container to be installed in the apparatus.

Referring to FIGS. 3, 4A, and 4B, when the toner container 32Y is set in the toner container mount 31 of the apparatus body 100A, a nozzle 91 of the apparatus body 100A pushes a shutter 35 of the toner container 32Y and is inserted into the toner container 32Y (a container body 33) through an opening 34*a*1. Accordingly, the toner contained in the toner container 32Y can be discharged through the nozzle 91.

Referring to FIG. 3, the toner container 32Y includes the container body 33 with a helical protrusion 33*a* that is disposed on an inner circumferential face of the container body 33. Specifically, the helical protrusion 33*a* protrudes inward from an outer circumferential face to the inner circumferential face thereof and for transporting toner from the left to the right of the container body 33 in FIG. 3 by rotation of the container body 33. The toner conveyed from the left to the right in FIG. 3 inside the container body 33 is discharged to the outside of the toner container 32Y through the nozzle 91.

Further, a gear 37 meshing with the drive gear 110 of the apparatus body 100A is disposed on the outer peripheral surface of a head portion, which is on the right side in FIG. 3, of the container body 33. When the toner container 32Y is installed in the toner container mount 31, the gear 37 meshes with the drive gear 110 of the apparatus body 100A. As a drive motor 115 is driven, the driving force is transmitted from the drive gear 110 to the gear 37, thus rotating the container body 33. The drive motor 115 and the drive gear 110 serve as a drive mechanism to rotate the container body 33.

A configuration and operation of the toner container 32Y are described in further detail later.

Referring to FIG. 3, the conveyance screw 92 is disposed inside the nozzle 91. As a motor 93 rotates the conveyance screw 92, the toner flowing into the nozzle 91 from the inflow port 91*a* (see FIG. 4A) in the toner container 32Y is conveyed by the conveyance screw 92 from the left to the right in FIG. 3. Thus, the toner is discharged through an outlet of the nozzle 91 to the hopper 81.

The hopper 81 is disposed below the outlet of the nozzle 91 via a downward path 82. A suction port 83 is disposed in the bottom portion of the hopper 81, and the suction port 83 is coupled to one end of the conveyance tube 95. The conveyance tube 95 is formed of a flexible material with low affinity for toner, and the other end of the conveyance tube 95 is coupled to a developer pump 60 (a diaphragm pump). The developer pump 60 is coupled to the developing device 5Y via the sub-hopper 70 and the conveyance pipe 96.

With such a configuration of the toner supply device 90, as the drive motor 115 drives the drive gear 110 (i.e., the drive mechanism), the container body 33 of the toner container 32Y rotates, thereby discharging toner from the toner container 32Y through the nozzle 91. The toner discharged from the toner container 32Y falls through the downward path 82 and is stored in the hopper 81. As the developer pump 60 operates, the toner stored in the hopper 81 is sucked together with air from the suction port 83 and is conveyed to the sub-hopper 70 via the conveyance tube 95 and the developer pump 60. Then, the toner conveyed to the sub-hopper 70 is appropriately supplied into the developing device 5Y via the conveyance pipe 96. That is, the toner in the toner container 32Y is conveyed in the direction indicated by broken line arrows in FIG. 3.

The toner detector 86 is disposed near the suction port 83 and indirectly detects that the toner contained in the toner container 32Y is depleted (toner depletion), or a state close thereto (toner near depletion). Then, the toner is discharged from the toner container 32Y based on the detection result of the toner detector 86.

For example, a piezoelectric sensor or a light transmission sensor can be used as the toner detector 86. The height of the detection surface of the toner detector 86 is set so that the amount of toner (deposition height) deposited above the suction port 83 is a target value.

Based on the detection result of the toner detector 86, a drive timing and a drive duration of the drive motor 115 are controlled to rotationally drive the toner container 32Y (the container body 33). Specifically, when the toner detector 86 detects that there is no toner at the detection position, the drive motor 115 is driven for a predetermined time. On the other hand, when the toner detector 86 detects that the toner is present at the detection position, the drive motor 115 stops. If the toner detector 86 continuously detects that the toner does not exist at the detection position even when such control is performed repeatedly, a controller of the image forming apparatus 100 determines that the toner contained in the toner container 32Y is depleted (toner depleted), or is close thereto (toner near depletion).

Next, referring to FIGS. 4A to 11, the configuration and operation of the toner container 32Y (and 32M, 32C, and 32K) as the developer container are described below.

FIGS. 5, 6, and 8A to 8D are side views illustrating a side of the toner container 32 opposite the side illustrated in FIG. 4 (right and left reversed drawing).

FIG. 8 is a schematic view illustrating the movement of the shutter 35 and the guide rod 36 in the opening direction when the toner container 32Y is set in the apparatus body 100A. For ease of understanding, illustrations of the nozzle 91 and the container body 33 is omitted.

As described above with reference to FIGS. 1 to 3, the toner container 32Y as the developer container contains toner as developer therein and is removable from the apparatus body 100A.

Figure 5:
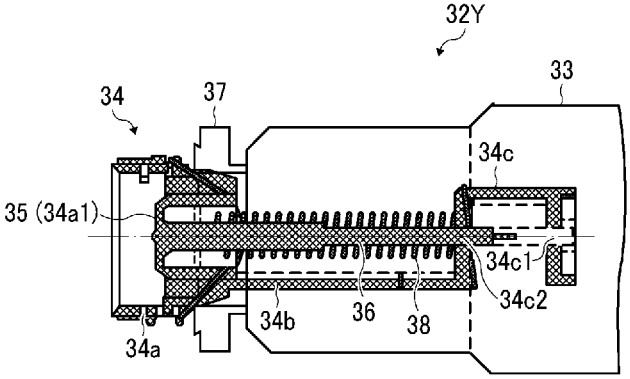
FIG. 5 is a cross-sectional view of a main part of the toner container according to an embodiment of the present disclosure.
Figure 6:
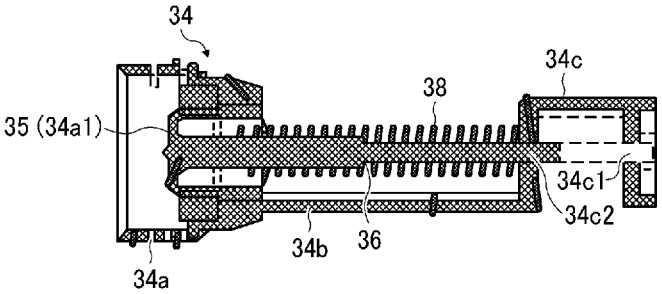
FIG. 6 is a cross-sectional view of a holder, a shutter, a rod, and a compression spring of the toner container according to an embodiment of the present disclosure.

Referring to FIGS. 4A, 4B, and 5, the toner container 32Y (the developer container) includes the container body 33, a holder 34, the shutter 35, the guide rod 36, a compression spring 38, and the like. The container body 33 rotatable relative to the holder 34 is bottle-shaped and has the helical protrusion 33*a* formed on the inner peripheral face thereof.

When the toner container 32Y is installed in the apparatus body 100A (the toner container mount 31), the holder 34 (and the shutter 35, the guide rod 36, and the compression spring 38) is held without rotation. The drive motor 115 (the drive mechanism) installed in the apparatus body 100A rotates the container body 33, thereby discharging the toner contained in the toner container 32Y through the nozzle 91.

With reference to FIGS. 4A to 6, the shutter 35 opens and closes the opening 34*a*1 (see FIG. 7) into which the nozzle 91 (installed in the apparatus body 100A) is inserted in conjunction with the installation of the toner container 32Y in the apparatus body 100A. The shutter 35 is made of a resin material and molded together with the guide rod 36 to be described later in one-piece. The shutter 35 fits into the opening 34*a*1 from the inside of the toner container 32Y and latched so as not to be removed from the container body 33. When the shutter 35 closes the opening 34*a*1, no toner is discharged from the toner container 32Y, and toner can be discharged from the toner container 32Y when the shutter 35 opens the opening 34*a*1.

The opening 34*a*1 is a substantially columnar hole portion centered on the center of rotation of the container body 33. The shutter 35 is shaped to fit into the opening 34*a*1 having such a columnar shape.

The guide rod 36 is united with the shutter 35. The guide rod 36 extends in the opening and closing direction of the shutter 35 (in the lateral direction in FIGS. 4A to 6) inside the toner container 32Y.

As illustrated in FIG. 5, the guide rod 36 is disposed so that the axis thereof substantially coincides with the center of rotation of the container body 33. Accordingly, even if the unexpected rotational force indirectly acts on the guide rod 36 held stationary when the container body 33 rotates, the position of the shutter 35 is not likely to shift.

Figure 7:
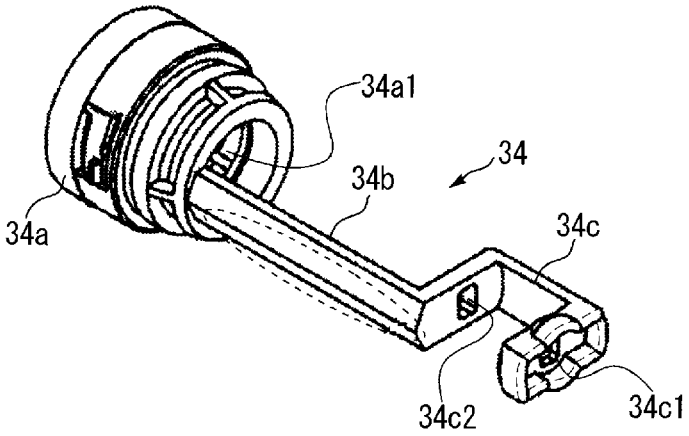
FIG. 7 is a perspective view of the holder of the toner container according to an embodiment of the present disclosure.

With reference to FIG. 7 (and FIGS. 4A to 6), the holder 34 includes a holding portion 34*c*, a fitting portion 34*a* (a cap portion), a bridge portion 34*b* and the like, and is secured not to rotate when installed in the apparatus body 100A.

The holding portion 34*c* of the holder 34 is located on the opposite side (left side in FIGS. 4A and 4B, and right side in FIGS. 5 and 6) to the shutter 35 installed inside the toner container 32Y. The holding portion 34*c* includes at least two portions to support the guide rod 36 movably in the opening and closing direction (two portions in the present embodiment).

More specifically, the holding portion 34*c* is a U-shaped frame in which two holes 34*c*1 and 34*c*2 are formed at positions separated from each other in the opening and closing direction. The guide rod 36 fits into the two holes 34*c*1 and 34*c*2. When combined with the bridge portion 34*b* to be described later, the holder 34 is shaped like a hook. The guide rod 36 is supported in a state close to cantilever support by the holding portion 34*c* disposed on one end side of the holder 34 in the direction of the rotation axis of the container body 33.

The fitting portion 34*a* (the cap portion) of the holder 34 has the opening 34*a*1 and is rotatably fitted in the container body 33. A seal is attached to the fitting portion 34*a* so that toner does not leak out from a gap between the fitting portion 34*a* and the container body 33. The fitting portion 34*a* includes an engagement portion to engage with an engaged portion formed in the toner container mount 31 so as to secure the fitting portion 34*a* to the toner container mount 31 in the circumferential direction of the container body. As a result, when the toner container 32Y is installed in the apparatus body 100A, the holder 34 is positioned at a position at which the bridge portion 34*b* to be described later is located below the guide rod 36.

The bridge portion 34*b* of the holder 34 connects the holding portion 34*c* and the fitting portion 34*a* inside the toner container 32Y (the container body 33). Here, in the present embodiment, the bridge portion 34*b* does not cover the periphery of the guide rod 36 (and the compression spring 38) in a wide range, but covers the periphery of the guide rod 36 (and the compression spring 38) in a narrow range, which is described later in detail.

Referring to FIGS. 4A to 6, the compression spring 38 (a biasing member) is wound around the guide rod 36 between the shutter 35 and the holding portion 34*c* and faces the bridge portion 34*b*. The compression spring 38 urges the shutter 35 in the direction of closing the opening 34*a*1 (to the right in FIGS. 4A and 4B, and to the left in FIGS. 5 and 6).

With such a configuration, the nozzle 91 pushes the shutter 35 in conjunction with the installation of the toner container 32Y to the apparatus body 100A (the toner container mount 31). Thus, the shutter 35 moves to the inside of the toner container 32Y together with the guide rod 36 against an urging force of the compression spring 38, thereby opening the opening 34*a*1. Specifically, the shutter 35 (and the guide rod 36) moves as illustrated in the order of FIGS. 4A and 4B (or FIGS. 8A, 8B, 8C, and 8D) to open the opening 34*a*1.

Figure 8A:
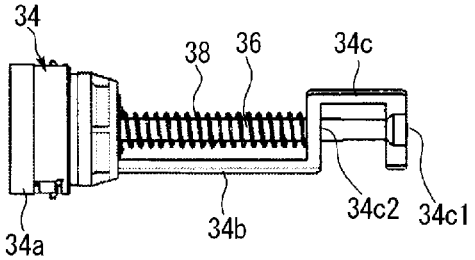
FIG. 8A is a schematic view illustrating a movement of the shutter and the guide rod of the toner container in a direction to open the opening.
Figure 8B:
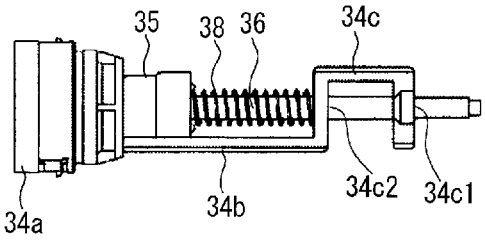
FIG. 8B is a schematic view illustrating the movement of the shutter and the guide rod of the toner container in a direction to open the opening.
Figure 8C:
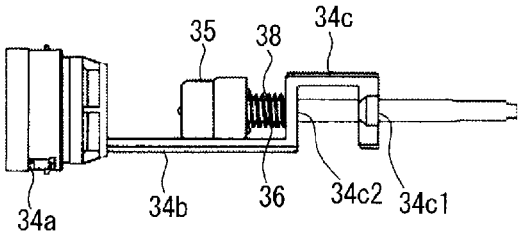
FIG. 8C is a schematic view illustrating the movement of the shutter and the guide rod of the toner container in a direction to open the opening.
Figure 8D:
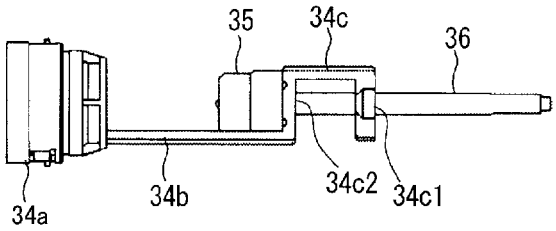
FIG. 8D is a schematic view illustrating the movement of the shutter and the guide rod of the toner container in a direction to open the opening.

On the other hand, the nozzle 91 releases the shutter 35 from the push in conjunction with the removal of the toner container 32Y from the apparatus body 100A (the toner container mount 31), and the shutter moves together with the guide rod 36 toward the opening 34*a*1 by the urging force of the compression spring 38, to close the opening 34*a*1. Specifically, the shutter 35 (and the guide rod 36) moves as illustrated in the order of FIGS. 4B and 4A (or FIGS. 8D, 8C, 8B, and 8A) to close the opening 34*a*1. As illustrated in FIGS. 4B and 8D, when the installation of the toner container 32Y in the apparatus body 100A is completed, the shutter 35 contacts the holding portion 34*c*, and the compression spring 38 is accommodated in the recess of the shutter 35. Accordingly, when the toner container 32Y is set in the apparatus body 100A, it is possible to prevent the toner in the container from adhering to the compression spring 38.

Figure 9:
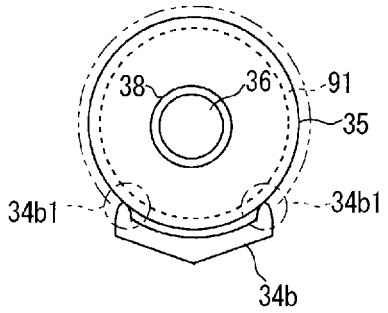
FIG. 9 is a cross-sectional view of the shutter and a bridge portion of the toner container according to an embodiment of the present disclosure.

Referring to FIG. 9, in the toner container 32Y according to the present embodiments, a range in which the bridge portion 34*b* faces the guide rod 36 and the compression spring 38 is smaller than a range in which the bridge portion 34*b* does not face the guide rod 36 and the compression spring 38.

Therefore, when the toner container 32Y is set in the apparatus body 100A and the toner can be discharged, as illustrated in FIGS. 4B and 9, the nozzle 91 faces the bridge portion 34*b* in a narrow range, and the wide range (the range indicated by a chain double-dashed line in FIG. 9) is opened. Specifically, in the present embodiment, the range of 270 degrees or more around the nozzle 91 (or the guide rod 36 and the compression spring 38) is open so as not to face the bridge portion 34*b* (the holder 34).

With this configuration, not only when the toner container 32Y is set in the apparatus body 100A, but also when the toner container 32Y is left alone for a long time, even if a force acts on toner between the bridge portion 34*b* of the holder 34, and the guide rod 36 and the compression spring 38 (or the nozzle 91) to agglomerate the toner, a space for escape to avoid the force is sufficiently secured. Therefore, toner can be inhibited from agglomerating at that position. As a result, this configuration prevents problems that aggregation of toner hinders the shutter 35 and the guide rod 36 (or the nozzle 91) from moving smoothly in the opening and closing direction, that the opening and closing failure of the shutter 35 occurs, and that the toner contained in the toner container 32Y is not discharged satisfactorily through the nozzle 91.

Further, when the nozzle 91 is inserted in the toner container 32Y, since the periphery of the nozzle 91 is opened in the wide range, the toner from the inflow port 91*a* of the nozzle 91 flows smoothly. Therefore, the position and the number of the inflow port 91*a* disposed on the nozzle 91 can be set freely without a large restriction. That is, the toner discharge performance from the toner container 32Y through the nozzle 91 is improved.

In the present embodiment, the bridge portion 34*b* of the holder 34 guides the shutter 35 moving in the opening and closing direction.

Specifically, as illustrated in FIG. 9, an opposing surface of the bridge portion 34*b* facing the shutter 35 is curved along the outer periphery of the shutter 35. As a result, as illustrated in FIGS. 8A to 8D, when the shutter 35 moves in the left-right direction in FIGS. 8A to 8D, the shutter 35 smoothly moves along the opposing surface of the bridge portion 34*b*.

As illustrated in FIG. 9, the bridge portion 34*b* includes a rail 34*b*1 in sliding contact with the shutter 35 moving in the opening and closing direction. The rail 34*b*1 stands upward on both sides of the opposing surface of the bridge portion 34*b*. With such a configuration, the shutter 35 does not move in the opening and closing direction while making surface contact with the opposing surface of the bridge portion 34*b*, but moves in the opening and closing direction while being in line contact with the rail 34*b*1. Therefore, the shutter 35 moves smoothly with a small sliding resistance.

Here, in the present embodiment, the two holes 34*c*1 and 34*c*2 disposed in the holding portion 34*c* have shapes to fit the engagement portion of the guide rod 36 so that the shutter 35 and the guide rod 36 do not rotate.

Referring to FIG. 7, the two holes 34*c*1 and 34*c*2 of the holding portion 34*c* of the holder 34 have an oval shape. The engagement portion of the guide rod 36 (which is the entire area of the range sliding in the hole portion) also has an oval shape so as to fit movably into the two oval holes 34*c*1 and 34*c*2. As a result, unlike the case in which the two holes 34*c*1 and 34*c*2 and the engagement portion of the guide rod 36 are circular, the guide rod 36 (and the shutter 35) does not rotate even if a force in a rotational direction acts on the guide rod 36. Therefore, the shutter 35 moves in the opening and closing direction and opens and closes the opening 34*a*1 smoothly.

Figure 10A:
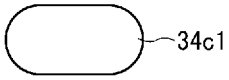
FIG. 10A is a schematic view of one hole formed in a holding portion of the holder.
Figure 10B:
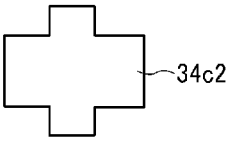
FIG. 10B is a schematic view of another hole formed in a holding portion of the holder.

Further, in the present embodiment, as illustrated in FIGS. 10A and 10B, the two holes 34*c*1 and 34*c*2 in the holding portion 34*c* can be formed so that the hole shapes thereof are different from each other. In the example of FIGS. 10A and 10B, the hole 34*c*1 has an oval shape and the other hole 34*c*2 has a cross shape that encloses the oval shape of the hole 34*c*1 when the oval shape of the hole 34*c*1 is projected. In addition, the engagement portion (the entire area of the range sliding through the hole portion) of the guide rod 36 has an oval shape so as to fit movably into both of the two holes 34*c*1 and 34*c*2. With such a configuration, the movement of the shutter 35 and the guide rod 36 in the rotational direction is restricted. Further, the two holes 34*c*1 and 34*c*2 having different shapes prevent the guide rod 36 from twisting. In addition, since the guide rod 36 sliding in the two holes 34*c*1 and 34*c*2 contacts the holding portion 34*c* at different positions, wear due to sliding of the guide rod 36 can be reduced.

Figure 11:
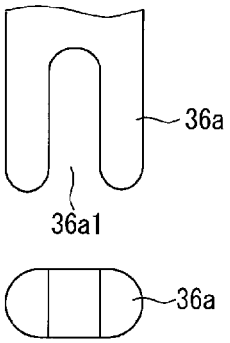
FIG. 11 is a schematic view of a tip of the guide rod.

Here, in the present embodiment, a tip 36*a* (which is not on the side of the shutter 35 but on the side of the holding portion 34*c*) of the guide rod 36 is branched into two like a fork as illustrated in FIG. 11. That is, a notch 36*a*1 is disposed in the tip 36*a* of the guide rod 36.

With such a configuration, the tip 36*a* of the guide rod 36 has elasticity in the direction in which the notch 36*a*1 is formed (horizontal direction in FIG. 11), and the guide rod 36 slides without large sliding resistance while fitting into the holes 34*c*1 and 34*c*2 of the holding portion 34*c*.

As illustrated in FIG. 7, in the present embodiment, a face of the bridge portion 34*b* that does not face the guide rod 36 and the compression spring 38 (which is the portion surrounded by the broken line in FIG. 7) is angular.

As a result, even when the bridge portion 34*b* has a small cross-sectional area, the second moment of area of the bridge portion 34*b* increases to strengthen the bridge portion 34*b*.

Figure 12A:
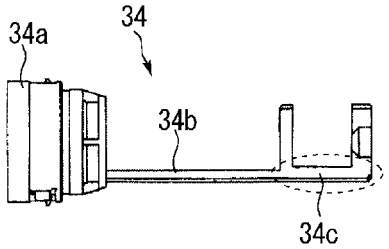
FIG. 12A is a schematic view of one variation of the holder.
Figure 12B:
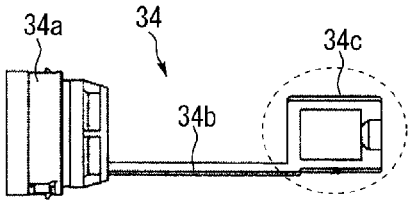
FIG. 12B is a schematic view of another variation of the holder. The accompanying drawings are intended to depict embodiments of the present disclosure and should not be interpreted to limit the scope thereof. The accompanying drawings are not to be considered as drawn to scale unless explicitly noted. In addition, identical or similar reference numerals designate identical or similar components throughout the several views.

FIGS. 12A and 12B are side views of the holders 34 as variations.

The holder 34 illustrated in FIG. 12A includes the holding portion 34*c* having a U-shape that is different in orientation from the above-described embodiment, and the shape combined with the bridge portion 34*b* is a substantially F-shape. In this configuration, the boundary portion between the bridge portion 34*b* and the holding portion 34*c* is reinforced.

Further, the holder 34 illustrated in FIG. 12B is different from that of the above-described embodiment in which the holding portion 34*c* is a U-shaped frame, and the holding portion 34*c* is a hollow-squared frame. In this configuration, the holding portion 34*c* itself can also be reinforced.

As described above, the toner container 32Y (the developer container) according to the present embodiment includes the shutter 35 to open and close the opening 34*a*1 into which the nozzle 91 is inserted, the guide rod 36 provided together with the shutter 35 in one piece, and the compression spring 38 that urges the shutter 35 in the closing direction. Further, the toner container 32Y includes the holder 34 including the holding portion 34*c* including at least two portions to support the guide rod 36 movably in the opening and closing direction, a fitting portion 34*a* having the opening 34*a*1 to fit into the container body 33, and the bridge portion 34*b* to connect the holding portion 34*c* and the fitting portion 34*a*. A circumferential area around the guide rod 36 and the compression spring 38 that faces the bridge portion 34*b* is smaller than a circumferential area around the guide rod 36 and the compression spring 38 that does not face the bridge portion 34*b*. In other words, on a cross section perpendicular to the axis of the guide rod 36, a range of the bridge portion 34*b* facing the guide rod 36 (and the compression spring 38) is smaller than half of an entire range of the guide rod 36 in the circumferential direction (in the direction of arc).

This configuration can attain that the shutter 35 and the guide rod 36 (or the nozzle 91) move smoothly in the opening and closing direction, or the toner (developer) contained in the toner container 32Y discharged satisfactorily via the nozzle 91.

Although the descriptions above concern the toner container 32Y as the developer container containing the toner (one-component developer) as developer, alternatively, the present disclosure can also be applied to a developer container containing two-component developer including toner and carrier. It is to be noted that, although the toner containers 32Y contains toner in the above-described embodiments, alternatively, the toner container 32Y installed in the toner supply device 90 (the developer supply device) can contain two-component developer including toner and carrier when used in image forming apparatuses that supply two-component developer to developing devices 5Y.

In such configurations, effects similar to those described above are also attained.

Further, in the present embodiment, the nozzle 91 is inserted into the toner container 32Y, and the toner is conveyed by rotating the conveyance screw 92 installed in the nozzle 91, but the nozzle 91 can be coupled to the pump to generate a negative pressure in the nozzle 91, thereby conveying the toner.

In such configurations, effects similar to those described above are also attained.

This patent application is based on and claims priority to Japanese Patent Application No. 2017-099157, filed on May 18, 2017, in the Japan Patent Office, the entire disclosure of which is hereby incorporated by reference herein.

REFERENCE SIGNS LIST

5Y Developing device
32Y, 32M, 32C, and 32K Toner containers (Developer containers)
33 Container body
34 Holder
34*a* Fitting portion
34*b* Bridge portion
34*c* Holding portion
35 Shutter
36 Guide rod
38 Compression spring
90 Toner supply device (Developer supply device)
91 Nozzle
100 Image forming apparatus
100A Apparatus body

The invention claimed is:

1. A developer container to be removably installed in an apparatus body of an image forming apparatus, the developer container comprising:

a container body to contain developer;

a shutter to open and close an opening of the developer container in conjunction with installation and removal of the developer container to and from the apparatus body, the opening into which a nozzle of the apparatus body is inserted;

a guide rod formed together with the shutter in one piece, the guide rod extending in an opening and closing direction of the shutter inside the developer container;

a holder including:

a holding portion disposed opposite the shutter in the developer container, the holding portion including at least two portions to support the guide rod movably in the opening and closing direction, the at least two portions including two walls facing each other in the opening and closing direction with a space therebetween, the two walls having respective holes to support the guide rod;

a fitting portion having the opening, to fit the container body; and a bridge portion to connect the holding portion and the fitting portion inside the developer container; and a compression spring wound around the guide rod, facing the bridge portion between the shutter and the holding portion, to urge the shutter in a direction to close the opening, wherein the shutter is pushed by the nozzle against an urging force of the compression spring in conjunction with the installation of the developer container to the apparatus body and moves into the developer container together with the guide rod, to open the opening, wherein the shutter is released by the nozzle in conjunction with the removal of the developer container from the apparatus body and moves toward the opening together with the guide rod by the urging force of the compression spring, to close the opening, and wherein a circumferential area around the guide rod and the compression spring that faces the bridge portion is smaller than a circumferential area around the guide rod and the compression spring that does not face the bridge portion.

2. The developer container according to claim 1, wherein the bridge portion of the holder guides the shutter to move in the opening and closing direction.

3. The developer container according to claim 2, wherein the bridge portion includes a rail in sliding contact with the shutter.

4. The developer container according to claim 1, wherein the holding portion has a U-shaped or a hollow-squared frame having the two holes separated from each other in the opening and closing direction.

5. The developer container according to claim 4, wherein an engagement portion of the guide rod engages the two holes of the holding portion to restrict rotation of the shutter and the guide rod.

6. The developer container according to claim 4, wherein the two holes have different shapes from each other.

7. The developer container according to claim 1, wherein a face of the bridge portion that does not face the guide rod and the compression spring is angular.

8. The developer container according to claim 1, wherein the container body is configured to rotate relative to the holder and is bottle-shaped with a helical protrusion on an inner circumferential face of the container body, wherein an axis of the guide rod coincides with a center of rotation of the container body, wherein the holder is held by the apparatus body without rotation, wherein the container body is rotated by a drive mechanism provided in the apparatus body, and wherein the developer contained in the developer container is discharged via the nozzle.

9. The image forming apparatus comprising the developer container according to claim 1, installed in the apparatus body to contain developer.

10. The developer container of claim 1, wherein the at least two portions include a connecting portion connecting the two walls to each other, a longitudinal direction of the connecting portion being in the opening and closing direction so that the connecting portion and the two walls form a U-shape.

11. The developer container of claim 10, wherein the longitudinal direction of the connecting portion and a longitudinal direction of the bridge portion are in the opening and closing direction.

12. The developer container of claim 10, wherein the holes are between the connecting portion and the bridge portion in a direction parallel to a longitudinal direction of the two walls.

* * * * *